United States Patent [19]

Handler

[11] Patent Number: 4,531,854

[45] Date of Patent: Jul. 30, 1985

[54] DEVICE FOR HOLDING SHEETS PROVIDED WITH PERFORATIONS

[76] Inventor: Anthony Handler, Mühlbachergasse 14, Vienna, Austria, A-1130

[21] Appl. No.: 521,052

[22] Filed: Aug. 8, 1983

[30] Foreign Application Priority Data

Aug. 23, 1982 [AT] Austria ..... 3189-82
Mar. 11, 1983 [AT] Austria ..... 871-83

[51] Int. Cl.[3] ..... B42F 3/04; B42F 13/20
[52] U.S. Cl. ..... 402/27; 402/23
[58] Field of Search ..... 402/36, 32, 27, 26, 402/24, 23, 21, 29

[56] References Cited

U.S. PATENT DOCUMENTS 331,259 11/1885 Shannon ..... 402/26
575,238 1/1897 Hotchkiss ..... 402/23
1,638,878 8/1927 Pott ..... 402/21
1,738,223 12/1929 Barnes ..... 402/23
1,791,916 2/1931 Watson ..... 402/27
2,709,439 5/1955 Schade ..... 402/23
4,172,675 10/1979 Lacourt ..... 402/27

FOREIGN PATENT DOCUMENTS 1160468 7/1958 France ..... 402/23

*Primary Examiner*—Paul A. Bell
*Assistant Examiner*—Paul M. Heyrana
*Attorney, Agent, or Firm*—Kurt Kelman

[57] ABSTRACT

The invention relates to a device for holding sheets provided with perforations, preferably endless perforations, in a folder. The holding device comprises a base body portion (6) and a holding loop member (7) with two limbs (12,16). One limb (12) can be rotationally fitted into the base body portion (6) through the perforations in the sheets which are disposed one upon the other, whereas the other limb (16) can be resiliently retained in the base body portion (6) by turning the loop member (7).

8 Claims, 11 Drawing Figures

Figure 1:
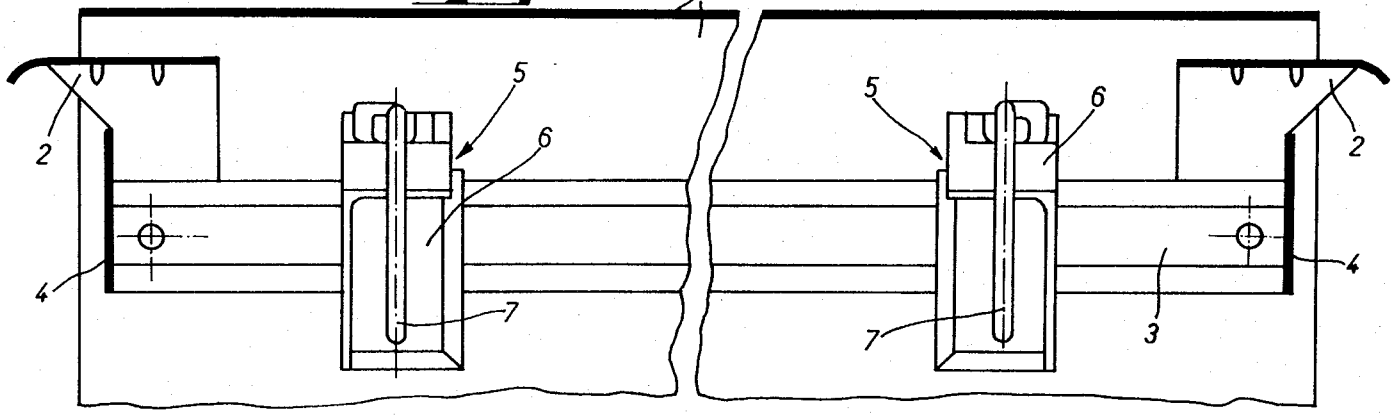

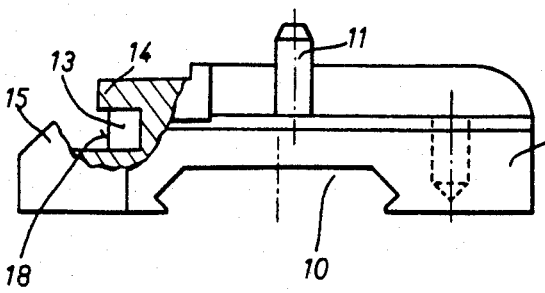
Fig. 4
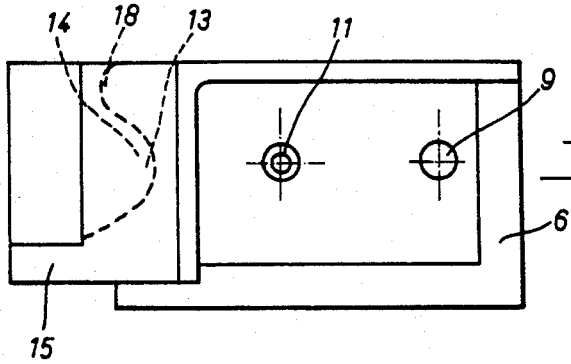
Fig. 5
Fig. 6
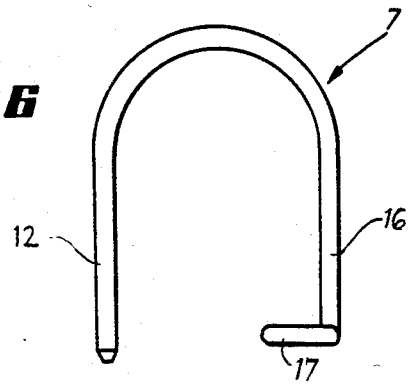
Fig. 7
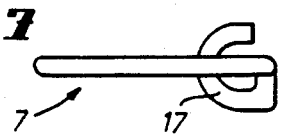

DEVICE FOR HOLDING SHEETS PROVIDED WITH PERFORATIONS

The invention relates to a device for holding sheets provided with perforations, preferably endless perforations at fixed spacings, wherein there is provided at least one loose holding loop member which has two limbs and which engages into perforations in the sheets to be held and which can be fitted into and anchored in a base body portion at least with one limb normal to the top thereof, in a bore therein, wherein a retaining means is provided in the base body portion for at least one of the limbs of the loop member.

A known device of that kind has loop members, wherein the loop member has notches close to the ends of the limbs thereof. For the purposes of securing the limbs in position, the base body portion displaceably carries a sheet metal bar which is provided with recesses and which engages into the notches in the limbs and which prevents the loop members from being pulled out. If the loop members are to be pulled out, the bar member only has to be displaced until the recesses are disposed in the region of the limbs and thus the bar member frees the loop members. The disadvantage of that known device is that it requires a considerable number of individual components and manufacture thereof requires a correspondingly high level of costs. In addition, the assembly of such a device also gives rise to considerable expense.

The aim of the present invention is to propose a device of the kind set forth above, which is easy to operate, which requires only a low level of assembly expenditure in manufacture thereof, and which has only a minimum number of individual components.

According to the invention, this object is accomplished by providing that one of the two limbs of the holding loop member can be rotationally fitted into the bore in the body portion and the other limb can be resiliently latched in the base body portion in the region of the free end of said other limb, by rotating the loop member. In this way, when manufacturing such a device, there is no need to produce corresponding latching elements for fixing the holding loop member in the base body portion, and to install such components in the body portion. In addition, the fact that only the one, preferably smooth limb is fitted into the perforations in the sheets to be secured, ensures that they are substantially treated carefully, so that there is scarcely any question of causing tearing or fraying of the perforations by virtue of fitting the loop member in place therein.

A particularly advantageous embodiment of the invention is characterised in that a portion which is formed on or outwardly of the other limb is formed by a hook which is of a loop-like configuration and which projects perpendicularly from said other limb and the retaining recess is formed by a trough-like depression in a side wall of the base body portion, wherein a projection extends over the depression in the region of the top side of the base body portion. The loop-like configuration of the hook ensures that the loop member can be easily slid into its retaining position, without causing damage to the material involved. By virtue of that arrangement, the base body portion can be easily manufactured from plastic material, for example by an injection moulding process, without thereby giving rise to the fear of a high rate of wear.

One of the two limbs of the loop member is preferably of a smooth configuration and can be rotatably inserted into the bore in the base body portion. The smooth limb of the loop member ensures that the perforations in the sheets to be held in position are substantially treated carefully when the loop member is being fitted into the perforations in the stack of sheets to be held in position.

In addition, the invention may provide that the spacing between the axes of the two limbs of the loop member corresponds to the spacing of an odd number, which is greater than one, of pitches in respect of the perforations of the endless perforation of the sheets to be bound, whereby it is readily possible to turn over the individual sheets carried by the loop members.

In order to facilitate aligning the individual sheets in a stack and inserting the loop members into the stack, it may further be provided that the base body portion has a locating pin which is disposed at a spacing, corresponding to the spacing of the perforations in the sheets, from a bore for receiving a limb of the loop member.

In order also to be able to hold stacks of different widths, a preferred embodiment provides that the base body portion can be displaceably mounted on a bar.

Figure 2:
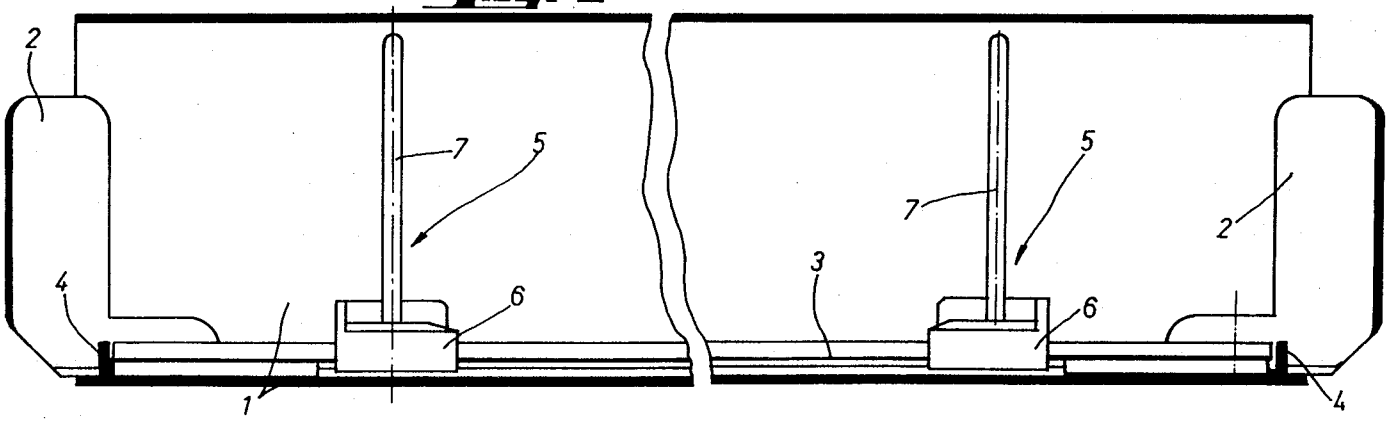
Figure 3:
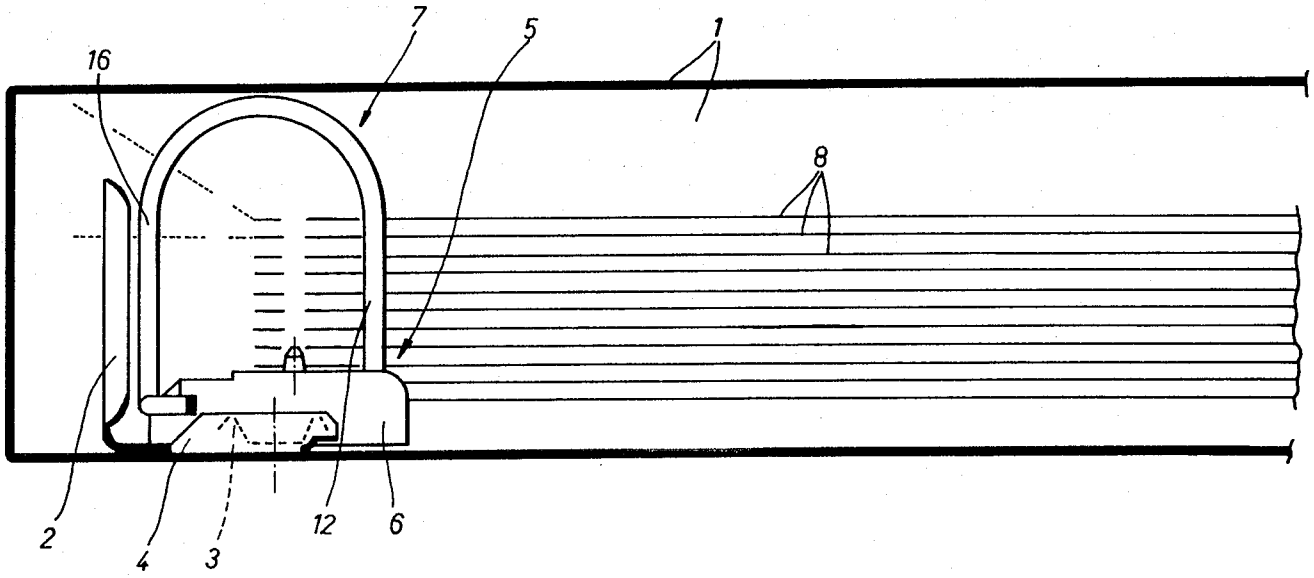
Figure 10:
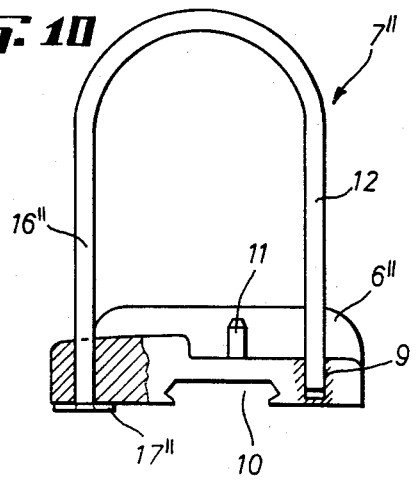
Figure 11:
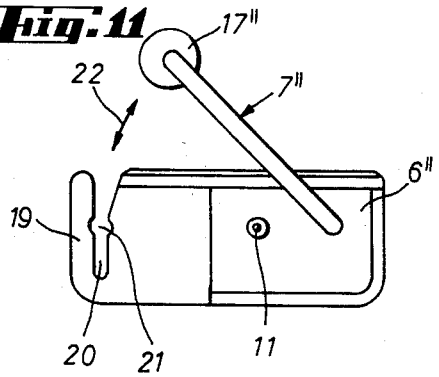

The invention will now be described in greater detail with reference to the drawings in which:

FIGS. 1, 2 and 3 show a plan view, a front view and a side view respectively of a hanging folder provided with devices according to the invention, FIGS. 4 and 5 show an elevational view and a plan view of a base body portion for a device as shown in FIGS. 1 to 3, FIGS. 6 and 7 show an elevational view and a plan view of a loop member for a device as shown in FIGS. 1 to 3, FIGS. 8 and 9 show an elevational view and a plan view of a further embodiment of a loop member with associated base body portion, and FIGS. 10 and 11 show an elevational view and a plan view of a further embodiment of a loop member with associated base body portion.

In the embodiment shown in FIGS. 1 to 7, a bar or rail 3 is secured to the lower cover portion of a folder 1, for example by riveting. Two holding devices 5 according to the invention are fitted displaceably on the bar 3. The displacement movement of the devices 5 is restricted by abutments 4. At the same time as the bar 3 is secured to the folder 1, two arms 2 which serve as a suspension means are also secured to the folder 1. The holding devices 5 comprise a base body portion 6 and a loop member 7 having two limbs 12 and 16. As can be seen from FIG. 3, the one limb passes through the perforations in the sheets 8 to be held, and engages into a bore 9 disposed at the top of the base body portion 6. As can be seen from FIG. 4, the base body portion 6 has a recess 10 which corresponds to the cross-section of the head portion of the bar 3. The base body portion 6 is thus slidable on the bar 3.

Disposed on the base body portion, normal to the longitudinal axis of the bar 3, is a locating pin 11 which is spaced from the bore 9 at the spacing of the divisions of the perforations of the sheets 8 to be held. The locating pin 11 is desirably formed integrally with the base body portion 6 which is preferably made from plastic material by an injection moulding process.

A trough-like depression 13 is disposed at the side of the base body portion 6 which extends parallel to the bar 3 and which is more remote from the bore 9 in which the smooth limb 12 of the loop member 7 is rotatable. The depression 13 is covered in an upward direction by a protection 14 and is laterally delimited by an abutment 15.

As can be seen from FIGS. 6 and 7, the loop member 7 has a smooth limb 12, the free end of which is of a conical configuration, and a limb 16, the free end of which is formed into a loop-like hook 17 which projects perpendicularly from the limb 16. The loop member 7 comprises a resiliently deformable material for example wire and can be readily made for example by bending.

When the loop member 7 is fitted with its smooth limb 12 into the bore 9 in the base portion 6 and thereafter rotated until the hook 17 slides over the bead portion 18 at the edge of the trough-like depression, with the loop member being resiliently expanded, the hook 17 and thus the loop member engages into the depression and can no longer be vertically removed from the base body portion 6 as the projection 14 thereon engages over the hook 17 on the loop member 7.

The embodiments of the loop member and the base body portion shown in FIGS. 8 to 11 can also be used for the folders shown in FIG. 1, and may also be displaced on the bars 3.

Figure 8:
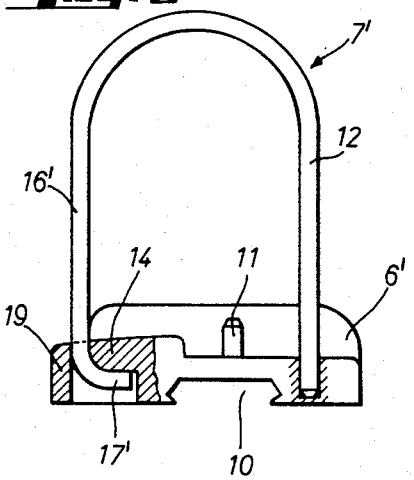
Figure 9:
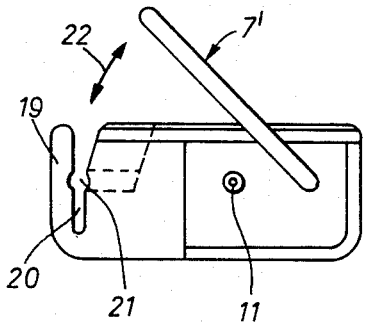

In the embodiment shown in FIGS. 8 and 9, the loop member 7' has a simple hook 17' on its limb 16', the hook 17' engaging under a projection 14', in the closed position.

The base body portion 6' has a resilient projection or lug 19 which is separated from the main part of the base body portion by a slot 20. When the limb is fitted into the base body portion 6', the limb 16' of the loop member can be pivoted into the slot 20 which has an enlarged-width portion corresponding to the limb 16', as indicated by the arrow 22. When the limb 16' is pivoted into the slot 20, the latter is resiliently expanded. In that embodiment, the dimensions of the two limbs 16' and 12 are so selected that the hook 17' bears firmly against the underside of the projection 14'. The limb 12 is of a smooth configuration and can be fitted into a bore in the base body portion 6'.

The embodiment of the loop member 7'' and the base body portion 6'' as shown in FIGS. 10 and 11 is very similar to the embodiment shown in FIGS. 8 and 9, except that, instead of the hook 17', the limb 16'' has a small plate member 17'' which is joined to the free end of the limb 16'', for example by means of spot welding, riveting or by an upsetting operation or by means of a screw-thread. The plate member 17'' simply bears against the underside of the base body portion 6'' when the loop member is in its closed position.

In all embodiments, the spacing of the centrelines of the limbs 12 and 16 is equal to the spacing of three pitches in respect of the perforations of the endless perforation in the papers to be held in place. By virtue of that arrangement, it is possible to turn over the sheets provided with endless perforations, even when the loop members are in their closed positions, as shown by the broken lines in FIG. 3.

I claim:

1. A device for holding sheets having perforations, preferably spatially fixed endless perforations, comprising:

(a) at least one loose holding loop member having two limbs, said loop member engaging into perforations in the sheets to be held, a first limb of the holding loop member being smooth with a continuous cross section at least in its anchor region, a second limb of the holding loop member having a portion which is formed thereon which projects laterally beyond the outer surface of said second limb; and (b) a base body portion into which is fitted and anchored said first limb of said holding loop member with said first limb normal to the top thereof in a bore therein, said base body portion including a retaining recess having a projection extending thereover and into which said laterally projecting portion of said second limb of said holding loop member is resiliently engaged in the closure position of said holding loop member.

2. A device according to claim 1, wherein the free end of the second limb of the loop member is formed as a hook which projects perpendicularly from said limb.

3. A device according to claim 1, wherein a small plate is secured to the free end of the second limb, the side of the plate facing the loop member bearing against the underside of the base body portion in the closure position of the loop member.

4. A device according to claim 1, wherein said laterally projecting portion of the second limb is formed by a hook which is of a looped configuration and which projects perpendicularly from said limb and which projects towards the first limb, and the retaining recess is formed by a trough-like depression which is disposed in a side wall of the base body portion and which has a projection engaging thereover, in the region of the top side of the base body portion.

5. A device according to claim 1, wherein the base body portion has a resilient lug which is separated by a slot, wherein the slot has an enlarged-width portion which corresponds to the second limb having said portion formed thereon, wherein the limb can be pivoted into said enlarged-width portion.

6. A device according to claim 1, wherein the spacing between the axes of the two limbs of the loop member corresponds to the spacing of an odd number, which is greater than 1, of pitches in respect of the perforations of the endless perforation of the sheets to be bound.

7. A device according to claim 1, wherein the base body portion has a locating pin which is disposed at a spacing, corresponding to the spacings of the perforations in the sheets, from the bore for receiving said first limb of the loop member.

8. A device according to claim 1, wherein the base body portion can be displaceably mounted on a bar.

* * * * *